United States Patent [19]

Jacrot

[11] Patent Number: 4,529,908

[45] Date of Patent: Jul. 16, 1985

[54] ELECTRIC INCANDESCENT LAMP FOR A MOTOR-CAR

[75] Inventor: Michel Jacrot, Chartres, France

[73] Assignee: U.S. Philips Corporation, New York, N.Y.

[21] Appl. No.: 422,933

[22] Filed: Sep. 24, 1982

[30] Foreign Application Priority Data

Oct. 16, 1981 [FR] France ..... 81 19485

[51] Int. Cl.[3] ..... H01K 1/50

[52] U.S. Cl. ..... 313/579; 313/115

[58] Field of Search ..... 313/578, 579, 580, 631

[56] References Cited

U.S. PATENT DOCUMENTS 3,706,901 12/1972 De Neve ..... 313/634 X 4,361,780 11/1982 Brons ..... 313/579 X

*Primary Examiner*—Palmer Demeo

*Assistant Examiner*—Sandra L. O'Shea

*Attorney, Agent, or Firm*—Robert S. Smith

[57] ABSTRACT

The invention relates to an electric incandescent halogen lamp for a motor-car, in which the substantially flat pinch allows the passage of internal current input conductors, between which two filaments are stretched. One current input conductor supports a cap constituting a screen of for a filament for giving a dipped beam and is prolonged into a curved end portion which is situated in a longitudinal plane perpendicular to the plane of the pinch and rests against the tubular wall of the bulb.

4 Claims, 2 Drawing Figures

ELECTRIC INCANDESCENT LAMP FOR A MOTOR-CAR

Figure 1:
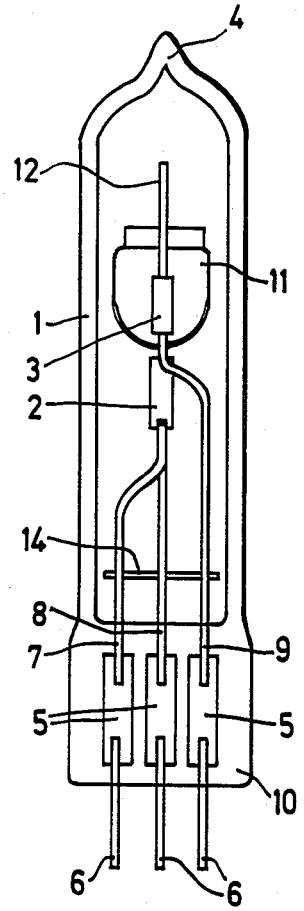

The invention relates to an electric incandescent halogen lamp for a motor-car comprising a glass tubular bulb which is hermetically sealed at a pinch according to a plane which is longitudinal with respect to the tubular bulb, the said pinch allowing the passage of current input conductors which penetrate into the interior of the bulb and have stretched between them in the bulb two filaments, one of which is partly masked by a cap, which constitutes a reflecting screen welded onto one of these current inputs, the said current input conductor being prolonged so that it longitudinally encompasses the cap. Such a lamp, which can be used to provide a dipping beam and a main beam, is known, for example, from the French Patent Specification No. 2,285,713.

The bulb of this known lamp is manufactured from a glass tube, a first end of which is closed by an exhaust tube. The internal electrical equipment of the bulb comprising three current input conductors, the filaments and the dipping cap, are fixed in the pinch which closes the tubular bulb at the end remote from the exhaust tube. This fixation has to be effected with great accuracy so that a correct position of the filaments with respect to the bulb, to the pinch, to the lamp base receiving the said pinch and finally to the reflector receiving the lamp on the motorcar is ensured. Accuracy is also required in the case in which such a lamp is utilized as a light source in a sealed lamp/reflector assembly. Especially, the internal equipment must not be displaced during the formation of the pinch by means of the pressure of jaws on the softened wall of the glass bulb. In fact this operation tends to cause the internal equipment to rotate about an axis extending transversely to the tubular bulb and parallel to the plane of the pinch, especially when the passage of current in the pinch is ensured by metal foils connected to internal current input conductors penetrating into the bulb and to external current input conductors emanating from the pinch.

In the lamp described in the French Patent Specification No. 2,285,713 the internal electrical equipment is prevented from rotating by means of a support engaged in the internal top of the exhaust tube of the bulb. This solution has two disadvantages. On the one hand, the position of the exhaust tube with respect to the tubular wall of the bulb would consequently have to be defined with great accuracy, which is usually not the case. On the other hand, this construction impedes the introduction of the internal electrical equipment during the assembly of the lamp on an automatic high-output machine (1500 lamps per hour, for example).

The invention has for its object to provide a lamp the internal equipment of which may readily be introduced into the bulb, while nevertheless its transverse displacement during the formation of the pinch is prevented. For this purpose, a lamp of the kind described in the preamble is characterized in that the said prolonged current input conductor constitutes a curved end portion situated in a longitudinal plane substantially perpendicular to the plane of the pinch and resting against the tubular wall of the bulb. The curvature of the end portion facilitates the introduction of the equipment into the bulb while compensating for the distances of the said equipment from the cylindrical wall of the bulb.

It is accentuated in the lamp according to the French Patent Specification No. 2,285,713 because the current input conductor encompassing the cap longitudinally is situated substantially in the plane of the pinch or parallel to this plane.

It was also known to use the cap itself for spacing the equipment from the tubular wall of the bulb by means of a transverse leg cut out of the material of the cap at its part near the exhaust tube of the bulb. The internal equipment of such a lamp has a transverse rib having a length substantially equal to the internal diameter of the bulb, the rib also impedes the introduction of the equipment.

In a preferred embodiment of the invention, the plane of the pinch is substantially parallel to the opening of the cap, the latter being consequently perpendicular to the plane of the curved end portion of the current input conductor. The current input conductor constituting the end portion and supporting the cap may thus be secured by welding, for example, in the proximity of the bottom of the cap and not near one of its edges, which would involve the risk of deformation of this edge and a change of the section of the light beam defined thereby. For the same reason, it is also preferable to utilize as a support for the cap the central current input conductor, which is therefore curved to constitute the curved end portion, whereas in the lamp described in the French Patent Specification No. 2,285,713, one of the outer current input conductors supports the vessel.

The following description and the drawings illustrate an embodiment of a lamp according to the invention.

Figure 2:
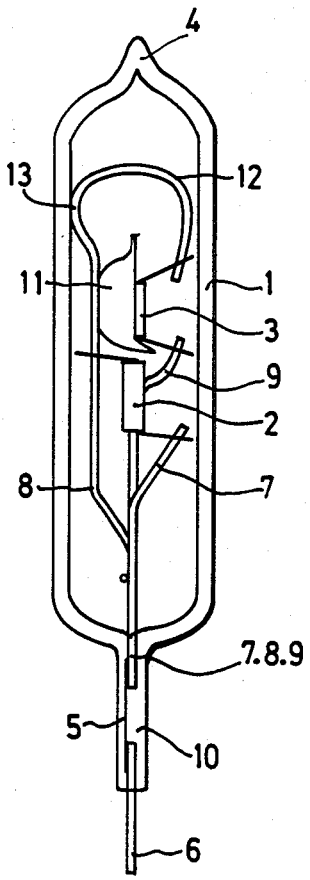

FIG. 1 is a front elevation of a lamp according to the invention showing the plane of the pinch, FIG. 2 is a side elevation of the lamp of FIG. 1 showing the plane of the curved end portion.

The figures show an electric incandescent lamp for a motor-car, the tubular bulb 1 of circular cross section of which is made, for example, of hard glass, the composition of which contains at least 80% by weight of $SiO_2$, or of quartz glass, which expression includes the glasses containing at least 95% by weight of $SiO_2$. The internal atmosphere of the bulb consists of a rare gas to which is added a halogenated compound, for example, hydrobromide. An important property of the incandescent halogen lamps is the small diameter of their bulb surrounding the filament(s) of tungsten (here 2,3) very closely so that a wall temperature is attained which is sufficiently high so that the tungsten-halogen compounds are volatile at this wall temperature and are not condensed on the bulb.

A first end of the bulb is closed by an exhaust tube 4. The other end is sealed hermetically by means of a pinch 10, which is substantially flat and is obtained by flattening between two jaws the softened glass of the bulb. The pinch includes three current lead through conductors 5, which are metal foils to which are connected on the one hand three external current input conductors 6 emanating from the pinch and on the other hand three internal current input conductors 7, 8, 9 penetrating into the bulb. The three assemblies of internal current input conductors, external current input conductors and current lead through conductors are situated in the pinch and in its proximity substantially in the same plane. The internal current input conductor 8 is situated between the two adjacent conductors 7 and 9.

The internal current input conductors 7, 8, 9 are prolonged in the bulb and receive the ends of the filaments 2 and 3, which are fed electrically through them. The filaments 2 and 3 are aligned longitudinally with respect to the tubular bulb, the filaments being positioned after the insertion of the lamp into the reflector of the motorcar in the proximity of the focus of this reflector. The filament 2 serves to create a main or high beam and its rectilinear ends are connected to the prolonged parts of the internal current input conductors 7 and 8. The filament 3, which serves to give a dipped or low beam, is partly masked by a cap 11, the opening or open face of which is longitudinal oriented with respect to the bulb and in this case parallel to the plane of the pinch. The cap 11 is welded at its bottom onto the prolonged part of the current input conductor 8, which constitutes beyond the cap a curved end portion 12 encompassing the cap 11 in a longitudinal plane substantially perpendicular to the plane of the pinch and so likewise to the plane of the opening of the cap. The free end of the curved end portion 12, which is arranged over the opening of the cap, receives the filament 3, which is further connected to the prolonged part of the current input conductor 9. The curved end portion 12 transversely touches the wall of the bulb 1 at at least one point 13 and serves to fix the position of the internal metal equipment transverse to the plane of the pinch. In FIG. 2, the current input conductors are welded onto the right-hand face of the metal bands, which in the pinch are consequently offset to the left with respect to the current input conductors. This offset tends to result in an inclination of the internal electrical equipment to the left at the formation of the pinch. This inclination is avoided by the curved end portion 12 abutting against the wall of the bulb at 13, on the lefthand side of FIG. 2. The curved form of the end portion and its position around the cap 11 further facilitate the introduction of the internal equipment into the bulb during the assembly of the lamp.

In the proximity of the pinch, the three internal current input conductors 7, 8, 9 are held in the aligned position in one plane by means of a metal rod 14 of, for example, molybdenum, which ensures the coherence of the metal equipment during the manufacture of the lamp. This rod 14 is destroyed later on by the passage of an electric current.

What is claimed is:

1. An electric incandescent halogen lamp for a motorcar comprising a glass tubular bulb hermetically sealed at a pinch, said pinch being disposed in a plane which extends longitudinally with respect to said tubular bulb, said lamp including a plurality of external current input conductors extending into said pinch, a plurality of metal foils each connected to respective external input conductors, each foil being disposed only in said pinch, a plurality of internal current input conductors, said internal input conductors being connected to respective metal foils in said pinch, each internal current conductor extending from said pinch into said bulb through said pinch into the interior of said bulb, first and second filaments, a cap constituting a reflecting screen disposed to mask said first filament, said cap being welded onto one of said plurality of current input conductors, said one of said plurality of current conductors being extended so that it longitudinally encompasses said cap, said one current input conductor having a curved end portion situated in a longitudinal plane substantially perpendicular to the plane of said pinch and resting against the tubular wall of the bulb.

2. A lamp as claimed in claim 1, wherein the cap has an open face and the plane of said pinch is substantially parallel to the open face of said cap.

3. A lamp as claimed in claim 1, wherein said one current input conductor has at least an axial portion centrally disposed in said bulb.

4. A lamp as claimed in claim 2, wherein said one current input conductor has at least an axial portion centrally disposed in said bulb.

* * * * *